United States Patent [19]

Nakamura et al.

[11] Patent Number: 4,477,392

[45] Date of Patent: Oct. 16, 1984

[54] VARIABLE VENTURI-TYPE CARBURETOR

[75] Inventors: Norihiko Nakamura; Takaaki Itoh; Takashi Katou, all of Mishima; Yozo Ota, Chiryu; Toshiharu Morino, Kuwana, all of Japan

[73] Assignees: Toyota Jidosha Kabushiki Kaisha; Aisan Industry Co., Ltd., both of Japan

[21] Appl. No.: 408,796

[22] Filed: Aug. 17, 1982

[30] Foreign Application Priority Data

Dec. 21, 1981 [JP] Japan ..... 56-205203

[51] Int. Cl.[3] ..... F02M 9/06

[52] U.S. Cl. ..... 261/39 A; 261/44 C

[58] Field of Search ..... 261/44 C, 44 B, 39 A

[56] References Cited

U.S. PATENT DOCUMENTS

| | | | |
|---|---|---|---|
| 3,243,167 | 3/1966 | Winkler | 261/44 C |
| 3,342,463 | 9/1967 | Date et al. | 261/44 C |
| 3,875,917 | 4/1975 | Scarritt, Sr. | 261/44 C |
| 4,110,417 | 8/1978 | Konishi et al. | 261/44 C |
| 4,276,238 | 6/1981 | Yoshikawa et al. | 261/44 C |
| 4,377,538 | 3/1983 | Wada | 261/44 C |

FOREIGN PATENT DOCUMENTS

| | | | |
|---|---|---|---|
| 2149818 | 12/1973 | Fed. Rep. of Germany | 261/44 C |
| 54-35523 | 3/1979 | Japan | 261/44 C |

*Primary Examiner*—Tim Miles

*Attorney, Agent, or Firm*—Finnegan, Henderson, Farabow, Garrett & Dunner

[57] ABSTRACT

A variable venturi-type carburetor comprising a vacuum chamber and an atmospheric pressure chamber which are separated by a suction piston. A needle is mounted on the central portion of the tip face of the suction piston. A suction hole, interconnecting the vacuum chamber to a venturi portion of the carburetor, is formed on the tip face of the suction piston at a position located upstream of the needle. The vacuum chamber is open to the atmosphere via a flow rate control valve apparatus when the engine temperature is low. The vacuum chamber is disconnected from the atmosphere by the flow rate control valve apparatus when the engine temperature is high.

6 Claims, 3 Drawing Figures

VARIABLE VENTURI-TYPE CARBURETOR

BACKGROUND OF THE INVENTION

The present invention relates to a variable venturi-type carburetor.

In a variable venturi-type carburetor equipped with a suction piston which changes the flow area of the venturi portion in response to a change in the amount of air fed into the cylinder of the engine, the velocity of air flowing within the venturi portion has a great influence on the atomization of the fuel. However, in a conventional variable venturi-type carburetor, since the velocity of the air flowing within the venturi portion is maintained approximately constant independently of the engine temperature, when the engine temperature is low, that is, when the viscosity of the fuel is high, the fuel is not sufficiently atomized as compared with when the engine temperature is high. As a result, a problem occurs in that a good combustion cannot be obtained.

SUMMARY OF THE INVENTION

An object of the present invention is to provide a variable venturi-type carburetor capable of promoting the atomization of fuel when the engine temperature is low.

According to the present invention, there is provided a variable venturi-type carburetor comprising: an intake passage formed in said carburetor and having an inner wall; a casing having therein an interior chamber which extends perpendicular to said intake passage; a suction piston movably inserted into said casing and having a tip face which projects into said intake passage and defines a venturi portion, said suction piston dividing the interior chamber of said casing into an atmospheric pressure chamber and a vacuum chamber and having a suction hole interconnecting said vacuum chamber to said venturi portion for moving said suction piston in response to a change in the amount of air flowing within said intake passage; a throttle valve arranged in said intake passage located downstream of said suction piston; a nozzle arranged on the inner wall of said intake passage, which faces the tip face of said suction piston; a needle mounted on the tip face of said suction piston and extending through said nozzle, said suction hole being formed on the tip face of said suction piston at a position located upstream of said needle; and a first means arranged in an air passage interconnecting said vacuum chamber to the atmosphere and controlling the fluid connection between said vacuum chamber and the atmosphere in response to a change in the engine temperature for connecting said vacuum chamber to the atmosphere when the engine temperature is lower than a predetermined value, but disconnecting said vacuum chamber from the atmosphere when the engine temperature is higher than the predetermined value.

The present invention may be more fully understood from the description of preferred embodiments of the invention set forth below, together with the accompanying drawings.

DESCRIPTION OF PREFERRED EMBODIMENTS

Figure 1:
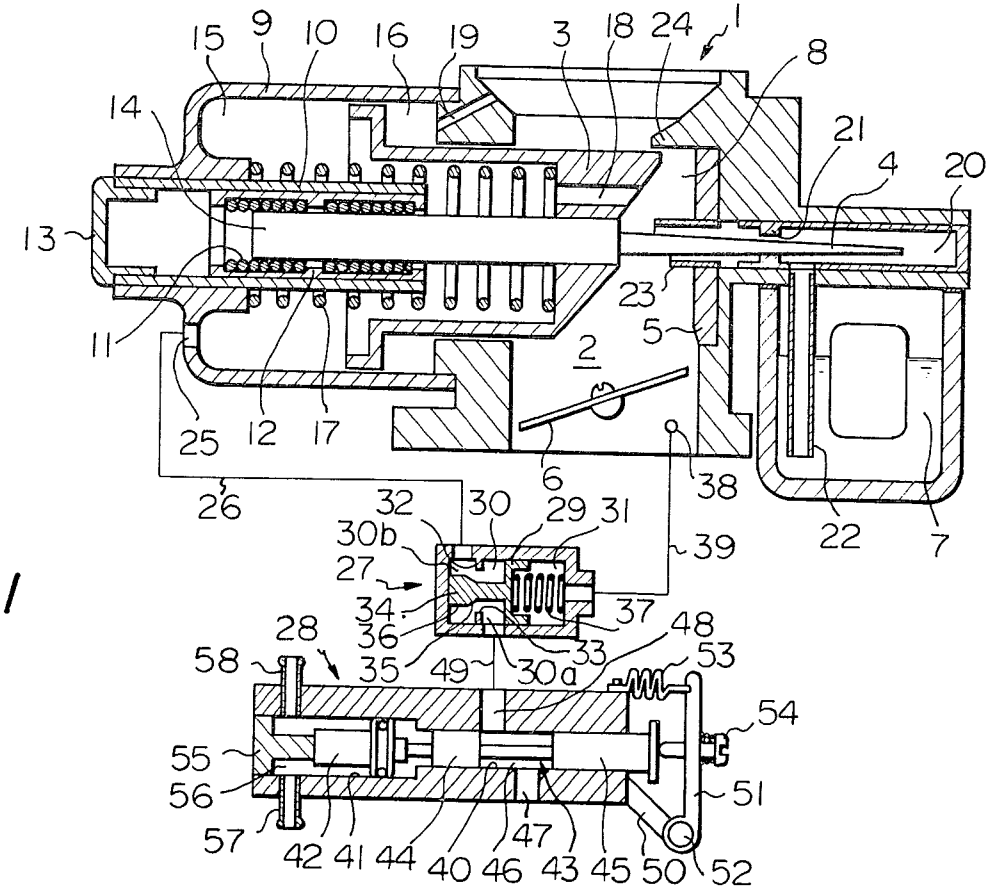
FIG. 1 is a cross-sectional side view of a variable venturi-type carburetor and a flow rate control device according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. Guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

Fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

A raised wall 24, projecting horizontally into the intake passage 2, is formed at the upper end of the spacer 5. A flow control is effected between the raised wall 24 and the tip end portion of the suction piston 3. When the engine is started, air flows downward within the intake passage 2. At this time, since the air flow is restricted between the suction piston 3 and the raised portion 24, a vacuum is created in the venturi 8. This vacuum acts on the vacuum chamber 15 via the suction hole 18. The suction piston 3 moves so that the pressure difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

A vacuum port 25, which is continuously open to the vacuum chamber 15, is formed on the casing 9. This vacuum port 25 is open to the atmosphere via an air conduit 26, a first flow rate control valve apparatus 27, and a second flow rate control valve apparatus 28. The first flow rate control valve apparatus 27 has a piston 29 slidably inserted thereinto. The interior of the first flow rate control valve apparatus 27 is divided into an atmospheric pressure chamber 30 and a vacuum chamber 31 by means of the piston 29. In addition, the atmospheric pressure chamber 30 is divided into an air inflow chamber 30*a* and an air outflow chamber 30*b* by means of a partition 32. The air outflow chamber 30*b* is connected to the vacuum chamber 15 via the air conduit 26. A valve port 33 is formed on the partition 32, and a valve body 34, controlling the opening area of the valve port 33, is formed in one piece on the piston 29. The valve body 34 has a frustum-shaped portion 35 and an increased diameter portion 36 having a diameter which is smaller than that of the valve port 33. A compression spring 37 for biasing the piston 29 toward the atmospheric pressure chamber 30 is inserted into the vacuum chamber 31. The vacuum chamber 31 is connected via a vacuum conduit 39 to a vacuum port 38 which is continuously open to the intake passage 2 located downstream of the throttle valve 6.

A reduced diameter bore 40 and an increased diameter bore 41 which are interconnected to each other are formed in the second flow rate control valve apparatus 28. A wax valve 42 is inserted into the increased diameter bore 41, and a push rod 43 is inserted into the reduced diameter bore 40. The push rod 43 has a pair of spaced, enlarged portions 44, 45. An atmospheric pressure chamber 46 formed between the enlarged portions 44 and 45 is open to the atmosphere via an air hole 47. In addition, an air outflow hole 48, which is covered or uncovered by the enlarged portion 44, is formed in the second flow rate control valve apparatus 28 and connected to the air inflow chamber 30*a* of the first flow rate control valve apparatus 27 via an air conduit 49. One end of a lever 51 is pivotally connected via a pivot 52 to an arm 60 fixed on the second flow rate control valve apparatus 28. A compression spring 53 is inserted between the second flow rate control valve apparatus 28 and the other end of the lever 51. An adjusting screw 54, which is in engagement with the projecting end of the enlarged portion 45 of the push rod 43, is screwed into the lever 51, and the push rod 43 is continuously biased toward the left in FIG. 1 due to the spring force of the compression spring 53. On the other hand, a plug 55 is screwed into the open end of the increased diameter bore 41, and the wax valve 42 is prevented from axially moving by the plug 55. A cooling water introducing chamber 56 is formed between the wax valve 42 and the plug 55, and a cooling water inflow pipe 57 and a cooling water outflow pipe 58 are connected to the cooling water introducing chamber 56.

FIG. 1 illustrates the case where the engine temperature is low, that is, illustrates the moment immediately after the engine is started. At this time, the enlarged portion 44 of the push rod 43 of the second flow rate control valve apparatus 28 completely opens the air port 48. Thus, the vacuum chamber 15 of the carburetor body 1 opens to the atmosphere via the first flow rate control valve apparatus 27 and the second flow rate control valve apparatus 28. Consequently, at this time, the pressure in the vacuum chamber 15 becomes approximately equal to the atmospheric pressure, moving the suction piston 8 in the direction wherein vacuum in the venturi portion 8 becomes great, that is, toward the right in FIG. 1. This increases the velocity of air flowing within the venturi portion 8, thus promoting the vaporization of fuel fed from the nozzle 23. In addition, since the vacuum in the venturi portion 8 becomes great, the air in the vacuum chamber 15 is sucked into the venturi portion 8 from the suction hole 18 at a high speed. The air sucked from the suction hole 18 further promotes the vaporization of fuel fed from the nozzle 23.

When the degree of opening of the throttle valve 6 is small, that is, when the amount of fuel fed from the nozzle 23 is small, a great vacuum acts on the vacuum chamber 31 of the first flow rate control valve apparatus 27 moving piston 29 toward the right in FIG. 1 against the compression spring 37, and, as a result, the opening area of the valve port 33 becomes small. Consequently, since vacuum in the vacuum chamber 15 becomes great as compared with when the opening area of the valve port 33 is maximum, vacuum in the venturi portion becomes small as compared with when the opening area of the valve port 33 is maximum. When the degree of opening of the throttle valve 6 becomes large and, thus, the amount of fuel fed from the nozzle 23 is increased, the vacuum in the vacuum chamber 31 of the first flow rate control valve apparatus 27 becomes small. The spring force of the compression spring 37 then moves the piston 29 toward the left in FIG. 1 and the valve body 34 maximally opens the valve port 33. Consequently, at this time, since the pressure in the vaccum chamber 15 of the carburetor body 1 becomes approximately equal to the atmospheric pressure, vacuum in the venturi portion 8 becomes great. This, therefore, increases the velocity of air flowing within the venturi portion 8 and, at the same time, increases the velocity of air sucked from the suction hole 18. As will be understood from the above description, as the amount of fuel fed from the nozzle 23 is increased, the velocity of air flowing within the venturi portion 8 is increased, and the velocity of air sucked from the suction hole 18 is also increased. Therefore, it is possible to promote the atomization of fuel fed from the nozzle 23 independently of the amount of fuel fed from the nozzle 23.

As the temperature of the cooling water of the engine is increased, the wax valve 42 causes the push rod 43 to move toward the right in FIG. 1. This gradually reduces, the opening area of the air outflow hole 48, thereby gradually increasing vacuum in the vacuum chamber 15. Consequently, as the temperature of the cooling water of the engine is increased, the velocity of air flowing within the venturi portion 8 and the velocity of air sucked from the suction hole 18 are gradually reduced. If the engine warm-up is completed, since the air outflow hole 48 of the second flow rate control valve apparatus 28 is completely covered by the enlarged portion 44 of the push rod 43, vacuum in the vacuum chamber 15 is maintained approximately constant independently of the degree of opening of the throttle valve 6.

Figure 2:
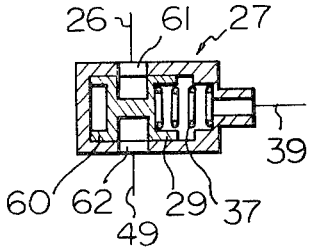
FIG. 2 is a cross-sectional side view of an alternative embodiment of the first flow rate control valve apparatus illustrated in FIG. 1.
Figure 3:
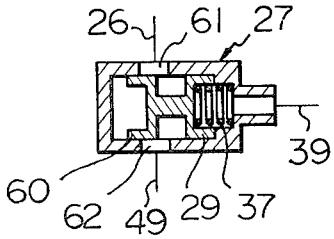
FIG. 3 is a cross-sectional side view of the first flow rate control valve apparatus illustrated in FIG. 2, which side view illustrates the case wherein the degree of opening of the throttle valve is small.

FIG. 2 illustrates an alternative embodiment of the first flow rate control valve apparatus 27. In this embodiment, a valve body 60 is formed in one piece on the piston 29, and the valve body 60 and the piston 29 have a symmetrical shape. In addition, the opening area of a valve port 61 connected to the air conduit 26 and the opening area of a valve port 62 connected to the air conduit 49 are controlled by the valve body 60. FIG. 2 illustrates the case wherein the degree of opening of the throttle valve 6 (FIG. 1) is large, and FIG. 3 illustrates the case wherein the degree of opening of the throttle valve 6 is small.

According to the present invention, when the temperature of the cooling water of the engine is low, since air is sucked into the venturi portion from the suction hole arranged upstream of the nozzle and, at the same time, the velocity of air flowing within the venturi portion is increased, it is possible to promote the atomization of fuel fed from the nozzle and, thus, obtain good combustion. In addition, since the velocity of air sucked from the suction hole and flowing within the venturi portion is increased as the amount of fuel fed from the nozzle is increased, it is possible to promote the atomization of fuel independently of the amount of fuel fed from the nozzle.

While the invention has been described with reference to specific embodiments chosen for purposes of illustration, it should be apparent that numerous modifications could be made thereto by those skilled in the art without departing from the basic concept and scope of the invention.

We claim:

1. A variable venturi-type carburetor comprising:

an intake passage formed in said carburetor and having an inner wall;

a casing having therein an interior chamber which extends perpendicular to said intake passage;

a suction piston movably inserted into said casing and having a tip face which projects into said intake passage and defines a venturi portion, said suction piston dividing the interior chamber of said casing into an atmospheric pressure chamber and a vacuum chamber and having a suction hole interconnecting said vacuum chamber to said venturi portion for moving said suction piston in response to a change in the amount of air flowing within said intake passage;

a throttle valve arranged in said intake passage located downstream of said suction piston;

a fuel nozzle arranged on the inner wall of said intake passage opposite the top face of said suction piston;

a needle mounted on the tip face of said suction piston and extending through said nozzle, said suction hole being formed on the tip face of said suction piston at a position located upstream of said needle;

an air passage interconnecting said vacuum chamber to the atmosphere;

first means arranged in said air passage for controlling the fluid connection between said vacuum chamber and the atmosphere in response to a change in the engine temperature, said first means varying the flow area in said air passage in response to variations of engine temperature below a predetermined value and preventing fluid communication between said vacuum chamber and the atmosphere when the engine temperature is above said predetermined value; and second means arranged in said air passage between said vacuum chamber and said first means for varying the flow area of said air passage in response to variations in vacuum generated in said intake passage downstream of said throttle valve, said first means preventing fluid-flow through said air passage when engine temperature is above said predetermined value regardless of the vacuum communicated to said second means.

2. A variable venturi-type carburetor according to claim 1, wherein a raised wall is formed on the inner wall of said intake passage, which faces the tip face of said suction piston, the tip face of said suction piston having an upstream end portion which cooperates with said raised wall for controlling the amount of air flowing within said venturi portion.

3. A variable venturi-type carburetor according to claim 2, wherein said raised wall is arranged upstream of and adjacent to said suction piston.

4. A variable venturi-type carburetor according to claim 1, wherein said second means comprises a valve device arranged in said air passage for reducing the flow area of said air passage in accordance with an increase in the level of vacuum which is produced in said intake passage located downstream of said throttle valve.

5. A variable venturi-type carburetor according to claim 4, wherein said valve device comprises a bore, a control piston slidably inserted into said bore and defining a vacuum chamber which is connected to said intake passage located downstream of said throttle valve, a valve port arranged in said air passage, and a valve body connected to said control piston and cooperating with said valve port for controlling the opening area of said valve port.

6. A variable venturi-type carburetor according to claim 1 wherein said first means comprises a valve biased to open said air passage and a wax valve exposed to engine coolant opposing the bias of said valve to gradually close said air passage in response to increasing engine coolant temperature.

* * * * *